US007374163B2

(12) United States Patent
Cook et al.

(10) Patent No.: US 7,374,163 B2
(45) Date of Patent: May 20, 2008

(54) MEDIA TRAY STACK HEIGHT SENSOR WITH CONTINUOUS HEIGHT FEEDBACK AND DISCRETE INTERMEDIATE AND LIMIT STATES

(75) Inventors: Willliam P. Cook, Lexington, KY (US); Daniel L. Carter, Georgetown, KY (US); Niki J. Murrell, Lexington, KY (US); Raymond J. Barry, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 352 days.

(21) Appl. No.: 10/970,774

(22) Filed: Oct. 21, 2004

(65) Prior Publication Data

US 2006/0087070 A1 Apr. 27, 2006

(51) Int. Cl.
*B65H 1/00* (2006.01)

(52) U.S. Cl. ..... 271/145

(58) Field of Classification Search ..... 271/145, 271/152, 154, 155; 356/632; 250/221, 229, 250/231.1, 231.11, 551; 270/58.09
See application file for complete search history.

(56) References Cited

U.S. PATENT DOCUMENTS 3,902,713 A 9/1975 Von Luhmann et al.
3,968,364 A 7/1976 Miller
4,566,547 A 1/1986 Furukawa
4,864,124 A 9/1989 Mirabella, Jr. et al.
5,028,041 A * 7/1991 Kobayashi ..... 271/9.03
5,067,704 A * 11/1991 Tsuihiji et al. ..... 271/262
5,078,379 A 1/1992 Leisner
5,098,080 A 3/1992 Arnone et al.
5,125,641 A 6/1992 Kruger
5,177,544 A 1/1993 Kimura et al.
5,200,608 A 4/1993 Kitajima
5,207,416 A 5/1993 Soler
5,518,230 A 5/1996 Scarlata et al.
5,551,686 A 9/1996 Sanchez et al.
5,622,364 A 4/1997 Dutton et al.
5,700,003 A 12/1997 Sung
5,823,529 A 10/1998 Mandel et al.
5,839,015 A 11/1998 Faguy et al.
5,842,694 A 12/1998 Brooks et al.
5,897,112 A 4/1999 Kwag
5,915,690 A 6/1999 Surya
5,961,115 A 10/1999 Blanck et al.
5,962,841 A * 10/1999 Okumura et al. ..... 250/205
6,000,871 A 12/1999 Fisher, Sr.
6,100,993 A 8/2000 Eom (Continued)

*Primary Examiner*—Patrick Mackey
*Assistant Examiner*—Jeremy R Severson
(74) *Attorney, Agent, or Firm*—Coats & Bennett, PLLC

(57) ABSTRACT

A media stack height sensor in an image forming apparatus with a flag arm that is in contact with a top surface a media stack. The arm is coupled to a flag characterized by varying transmissivity. The flag is moveable by the flag arm so that as the position of the arm changes in relation to the stack height, a different portion of the flag is positioned between a transmitter and receiver of an optical sensor disposed within the body of the image forming apparatus. The flag accordingly reduces the amount of optical energy received by the receiver. The receiver output signal indicates the height of the media stack. The flag also includes features that further limit light transmission to the receiver to provide discrete stack height indications such as low, empty, full, or intermediate states.

68 Claims, 10 Drawing Sheets

U.S. PATENT DOCUMENTS 6,206,362 B1 3/2001 Tan et al.
6,252,654 B1 6/2001 Kaya
6,408,147 B1 * 6/2002 Oshida ..... 399/82
6,585,344 B2 7/2003 Kolodziej
6,592,119 B2 7/2003 Goldbeck et al.
6,639,238 B2 10/2003 Kuo et al.
6,724,506 B1 4/2004 Wang

* cited by examiner

MEDIA TRAY STACK HEIGHT SENSOR WITH CONTINUOUS HEIGHT FEEDBACK AND DISCRETE INTERMEDIATE AND LIMIT STATES

BACKGROUND

A media tray in an image forming apparatus may be equipped with a stack height sensor to detect the presence, absence, or quantity of media contained therein. It is also useful to particularly detect discrete states within the range of stack heights. For instance, sensors may be used to indicate full, intermediate, and empty conditions so that informational and operational warnings may be provided. One intermediate state of interest is a low condition. Low warnings are useful to determine whether enough media remains in the media tray to complete a print job. The same low warning may also be used to alert users of the condition so that they can add media before the media tray becomes completely empty. An empty condition signal is useful to alert users and, in some cases, prevent operation of the image forming apparatus to prevent damage or unnecessary wear. Some stack height sensors use a single sensor for each discrete height. For instance, two separate sensors may be used to generate a signal indicative of the low and empty conditions. Unfortunately, for these types of systems, stack heights other than these discrete positions will be unknown and unavailable.

Other stack height indicators use a continuously variable sensor that provides a signal that changes in proportion to the amount of media remaining in the media tray. These continuously variable sensors can provide stack height values over the entire range of heights. However, since most media sheets used in an image forming apparatus are thin in relation to the height of a stack, it is difficult to precisely determine when the discrete conditions are encountered. The output of a continuously variable sensor generally does not change a large amount as the height or position of a media stack changes as individual sheets are removed or added to the stack. Thus, systems that use a continuously variable sensor look for an expected range of sensor outputs to simulate discrete states.

Space limitations make integrating these components into an image forming apparatus increasingly difficult. Consequently, design and manufacturing constraints sometimes permit only one or another type of stack height sensor.

SUMMARY

The present invention is directed to a stack height sensor that may be used in an image forming apparatus. The invention includes a flag arm moveably disposed in the image forming apparatus and in contact with a top surface of the media stack. The position of the flag arm changes as the height of the media stack changes. An optical sensor having a transmitter and a receiver is also disposed in the image forming apparatus. The flag arm is coupled to a flag that is characterized by a variable transmissivity and is positioned to interrupt the optical path between the transmitter and receiver. As the position of the flag arm changes in relation to the stack height, a different portion of the flag interrupts the amount of optical energy received by the receiver. In one embodiment, the flag has a ramped cross section that varies in thickness. In one embodiment, the flag has a textured surface indicating that a limit (e.g., empty) of the media stack has been reached. In one embodiment, the flag has a step corresponding to an intermediate condition, such as a low media state. The textured and step features further limit the amount of optical energy received by the receiver. As such, these features are distinguishable as discrete media stack heights.

The receiver is electrically coupled to an output circuit to generate signal indicative of the stack height. Further, when the media tray is removed from the image forming apparatus, the flag arm is lifted and moves the flag out of the sensor optical path so that it does not interrupt the light received by the receiver. With the flag removed, the optical sensor and the electrical circuit can be calibrated.

DETAILED DESCRIPTION

Figure 1:
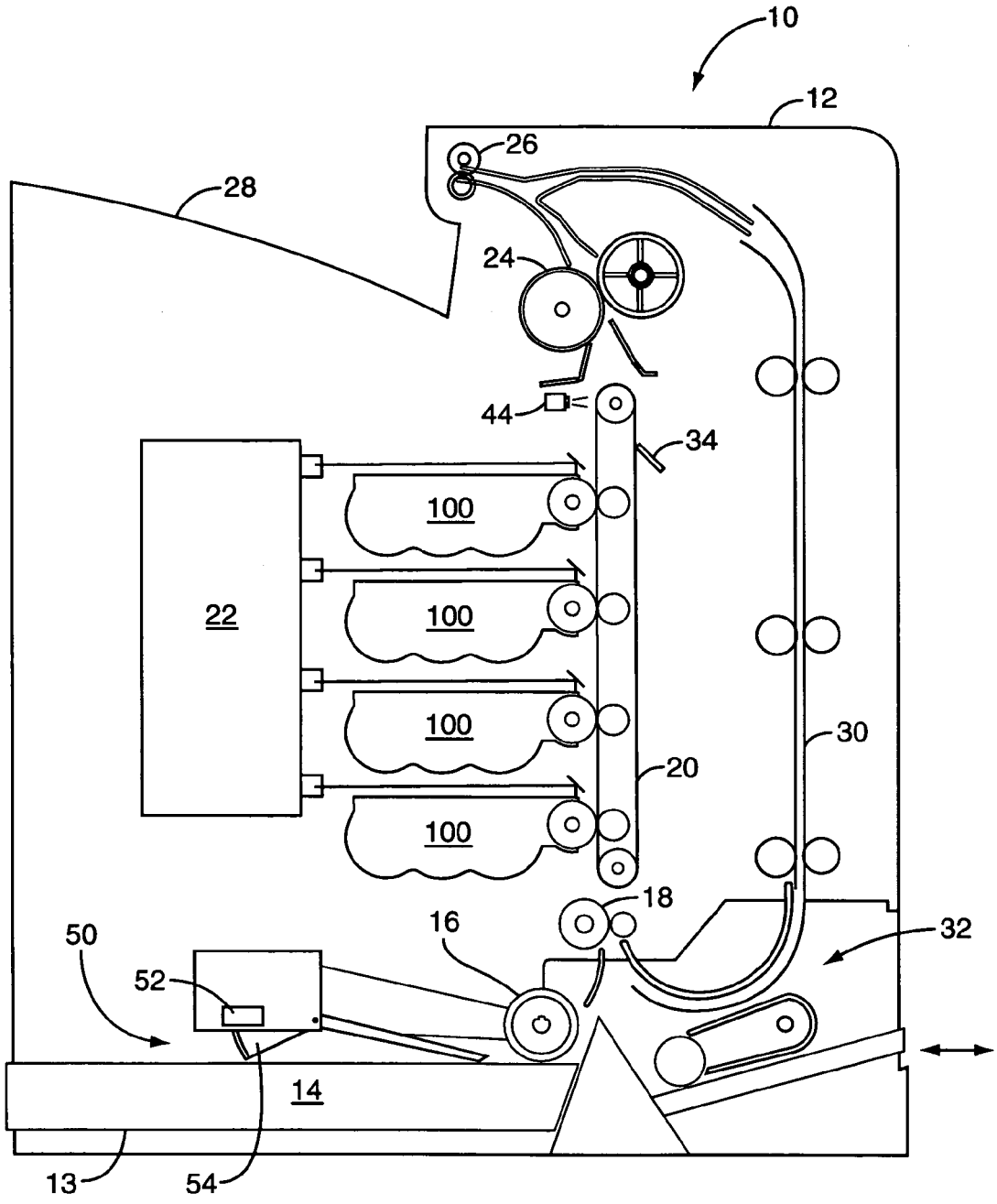
FIG. 1 is a functional block diagram of an image forming apparatus according to one embodiment of the present invention.

The present invention is directed to a sensor adapted to provide a signal indicative of the height of a media stack. One application of the stack height sensor is within an image forming apparatus as generally illustrated in FIG. 1. FIG. 1 depicts a representative image forming apparatus, such as a printer, indicated generally by the numeral 10. The image forming apparatus 10 comprises a main body 12, at least one media tray 13 holding a stack of print media 14, a pick mechanism 16, a registration roller 18, a media transport belt 20, a printhead 22, a plurality of image forming stations 100, a fuser roller 24, exit rollers 26, an output tray 28, and a duplex path 30.

The media tray 13, disposed in a lower portion of the main body 12, contains a stack of print media 14 on which images are to be formed. The media tray 13 is preferably removable for refilling. Pick mechanism 16 picks up media sheets from the top of the media stack 14 in the media tray 13 and feeds the print media into a primary media path. Registration roller 18, disposed along a media path, aligns the print media and precisely controls its further movement along the media path. Media transport belt 20 transports the print media along the media path past a series of image forming stations 100, which apply toner images to the print media. Color printers typically include four image forming stations 100 for printing with cyan, magenta, yellow, and black toner to produce a four-color image on the media sheet. The media transport belt 20 conveys the print media with the color image thereon to the fuser roller 24, which fixes the color image on the print media. Exit rollers 26 either eject the print media to the output tray 28, or direct it into a duplex path 30 for printing on a second side of the print media. In the latter case, the exit rollers 26 partially eject the print media and then reverse direction to invert the print media and direct it into the duplex path. A series of rollers in the duplex path 30 return the inverted print media to the primary media path for printing on the second side. The image forming apparatus 10 may further include an auxiliary feed 32 to manually feed media sheets.

In accordance with the present invention, the image forming apparatus also has a stack height sensor, generally indicated by reference number 50, which includes a sensor 52 and an actuator 54. As shown in FIG. 1, the stack height sensor 50 is configured to provide an indication of the amount of media contained in media stack 14. The height of the media stack 14 will gradually decrease with normal use as media sheets are pulled by pick mechanism 16 and transferred through the image forming apparatus 10 to receive images. Thus, this particular application of the stack height sensor 50 is adapted for use with a diminishing media stack. Those skilled in the art will understand that the stack height sensor 50 may also be implemented at a media output stack 28 where the stack height increases during normal use. The stack height sensor 50 may be mounted within the main body of the image forming apparatus 10 or coupled to a media input tray 13 or output tray 28 as necessary.

Figure 2:
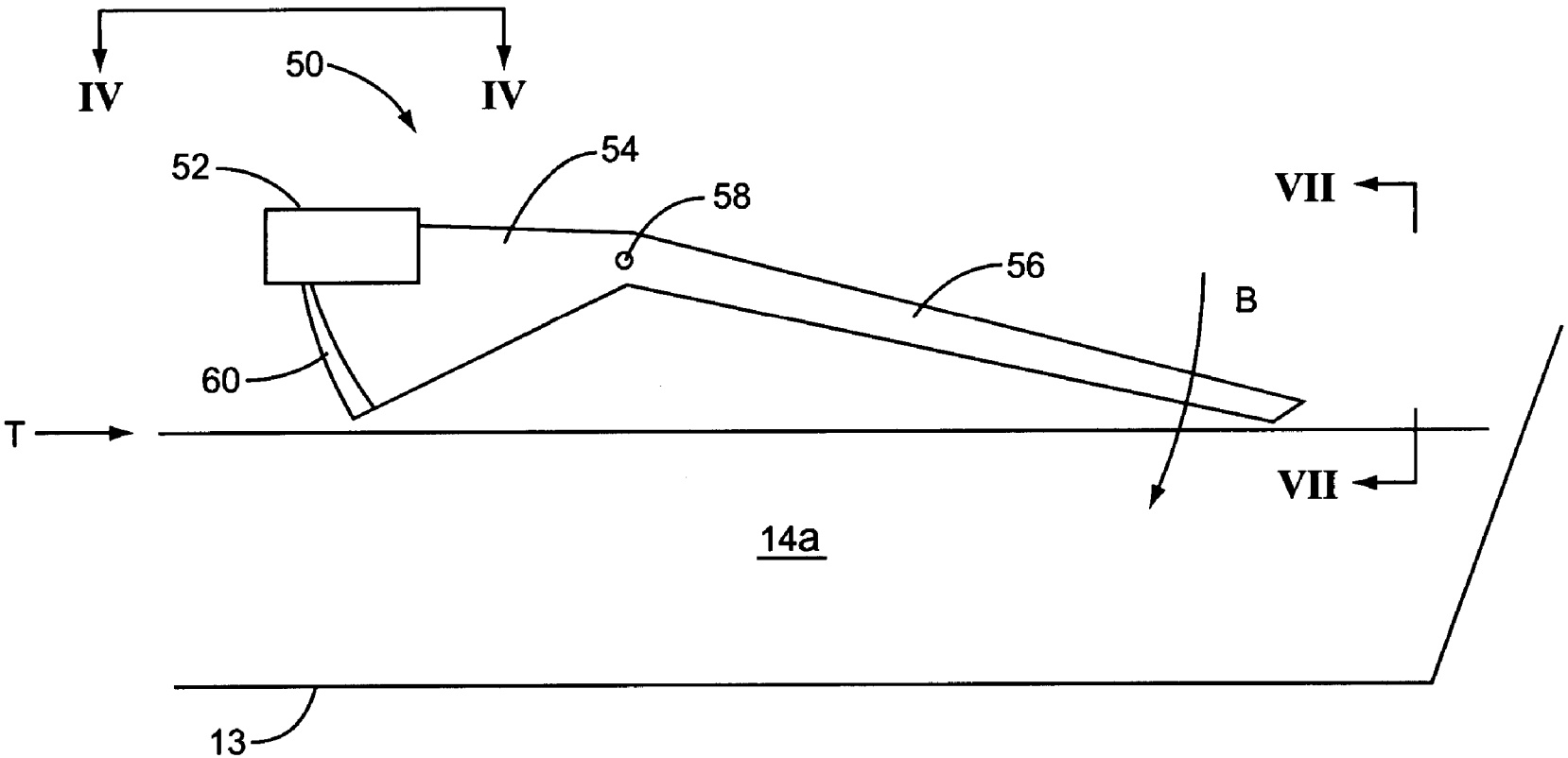
FIG. 2 is a side view of the stack height sensor with a full media stack according to one embodiment of the present invention.

FIG. 2 shows a side view of the stack height sensor 50. The media stack shown in FIG. 2 is full and is designated 14*a* to distinguish the media stack 14 shown in other Figures. As indicated above, the stack height sensor 50 includes a sensor 52 and an actuator 54. The actuator 54 has a flag 60 and an arm 56 that pivot about axis 58. The pivot axis 58 is generally parallel to the sheets contained in the media stack 14*a*. The arm 56 is biased in the direction indicated by the arrow labeled B into contact with the uppermost sheet T of the media stack 14. In the embodiment shown, there is no external bias element and the arm tends to swing downward under its own weight. However, in other embodiments, an external bias force may be applied by coil springs, leaf springs, or the like.

Figure 3:
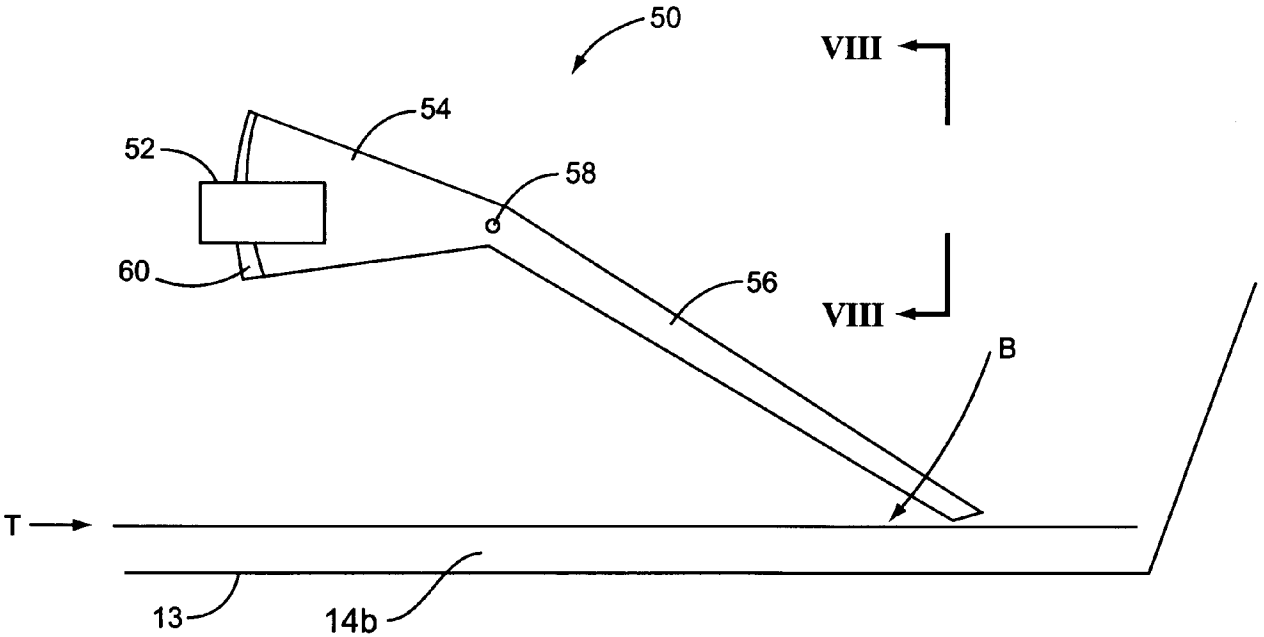
FIG. 3 is a side view of the stack height sensor with a low media stack according to one embodiment of the present invention.

Since arm 56 is biased into contact with the uppermost sheet T of the stack 14, the position of the arm 56 will change as the height of the stack 14 (and hence, the location of surface T) changes. The flag 60 is coupled to the arm 56 and also changes position as the height of the stack 14 changes. Sensor 52 is stationary during normal use. Consequently, the position of the flag 60 relative to sensor 52 changes according to the height of the stack 14. In FIG. 2, the full media stack 14*a* positions the arm 56 upward and the flag 60 downward relative to the pivot axis 58 and in comparison to their respective positions with a low media stack 14*b* as shown in FIG. 3. In FIG. 3, the media stack 14*b* is closer to an empty condition and the position of the uppermost sheet T is lower than is shown with stack 14*a* of FIG. 2. As sheets are pulled from the stack 14, arm 56 is rotated downward (clockwise in FIGS. 2-3) to remain in contact with the uppermost sheet T and flag 60 is rotated upward.

Figure 4:
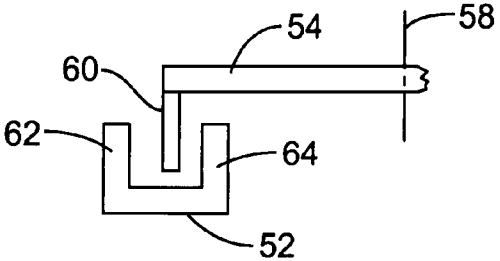
FIG. 4 is a top view of the stack height sensor according to one embodiment of the present invention.

In one embodiment shown in FIG. 4, flag 60 protrudes from the main body of actuator 54 along the same direction as the axis of rotation 58. Flag 60 is positioned to move within sensor 52, which comprises a transmitter 62 and a receiver 64. The transmitter 62 emits a signal that is detectable by receiver 64. In one embodiment, the signal is electromagnetic energy. In one embodiment, sensor 52 is an optical sensor. Thus, transmitter 62 emits optical energy with a frequency spectrum that is detectable by receiver 64. The transmitter 62 may be embodied as an LED, laser, bulb or other source. Receiver 64 changes operating characteristics based on the presence and quantity of optical energy received. The receiver 64 may be a phototransistor, photodarlington, or other detector. The optical energy may consist of visible light or near-visible energy (e.g., infrared or ultraviolet). Further, flag 60 is positioned within the transmission path between the transmitter 62 and receiver 64. Where an optical sensor 52 is used, the flag is positioned within the optical path between the transmitter 62 and receiver 64. As such, the flag 60 operates as an interrupter of sorts. However, the flag 60 is comprised of a transmissive material and does not completely interrupt energy transmission such that some fraction of the optical energy emitted by the transmitter 62 that is incident on the flag 60 is transmitted through the flag 60 and received by the receiver 64. Portions of the flag 60 may be completely opaque as described herein. The amount of optical energy that is ultimately received by the receiver 64 varies in relation to the position of the flag 60 within the transmission path of sensor 52.

The position of the flag 60 within sensor 52 is significant because flag 60 has a variable opacity or variable transmissivity. At one extreme, the flag 60 may be completely opaque and function as a conventional interrupter. However, at the other end of the flag 60, the flag may be at least partially transparent, so some amount of energy from transmitter 62 is allowed to pass through the flag 60 and reach the receiver 64. Between the extremes, the flag 60 may have a transmissivity gradient that allows increasing or decreasing amounts of energy to pass depending on the position of the flag within the sensor 52. In one embodiment, the flag 60 is constructed of a transparent material having a printed or etched opaque pattern of varying coverage. In another embodiment, the flag 60 is constructed with a partially transparent material overlaid onto a transparent substrate. In another embodiment, the flag 60 is constructed of a material having a substantially transmissive base material and a filler that is less transmissive. One example of this material is a polycarbonate base material such as GE Lexan® 121 Model Number GY1A110T available from General Electric in Pittsfield, Mass.

Figure 5:
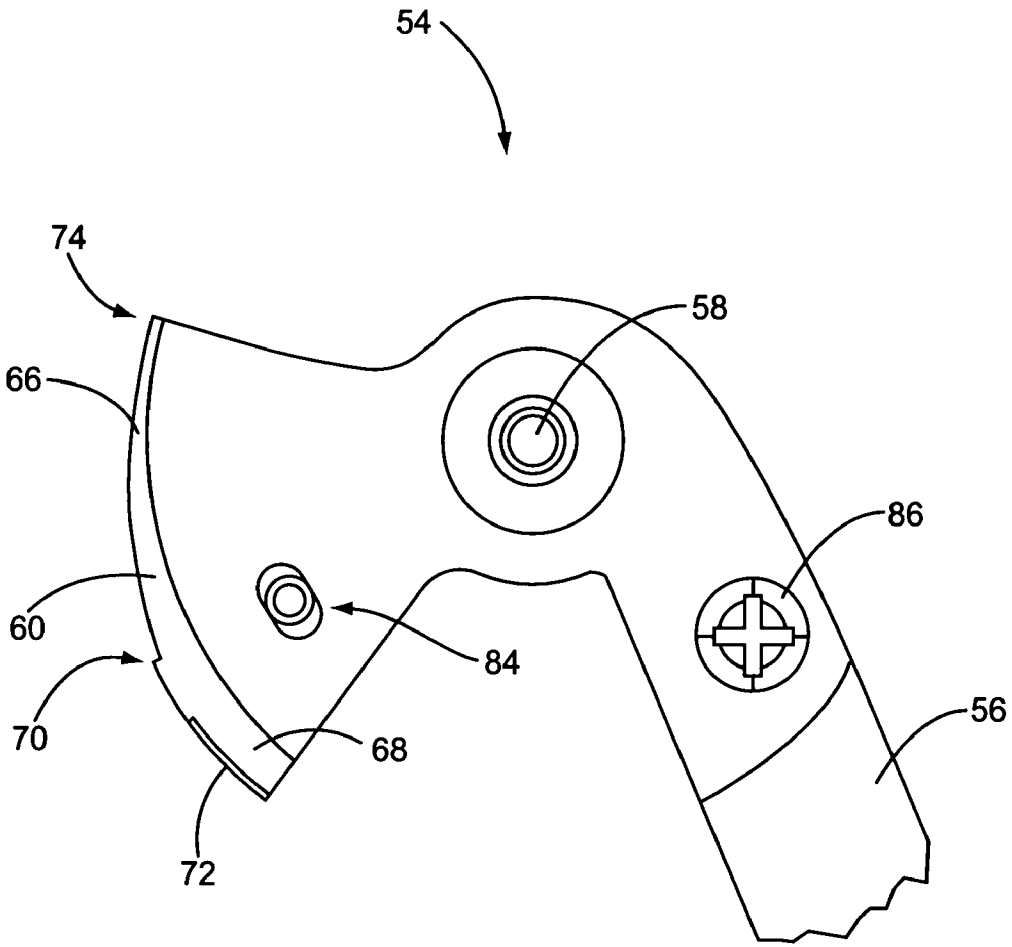
FIG. 5 is a side view of the stack height sensor flag according to one embodiment of the present invention.

Another non-limiting example of the flag is seen in the embodiment shown in FIG. 5. The flag 60 is coupled to a separate arm 56, both pivoting about a common axis of rotation 58. The flag 60 and arm 56 may be held in position relative to one another via a pin/slot configuration 84, a screw 86, or other hardware combination. In another embodiment, the flag 60 and arm 56 may be constructed as a single actuator member 54.

The flag 60 shown in FIG. 5 is transmissive and varies in thickness or cross-section. As the actuator 54 rotates about axis 58 in response to changing stack heights, the thickness of that portion of the flag 60 that is located in the transmission path between the transmitter 62 and receiver 64 (see FIG. 4) also changes. In the embodiment shown in FIG. 5, the flag 60 consists of a ramped section 66 and a thicker, constant-thickness section 68 that are separated by step 70. The ramped section 66 has a relatively thin section 74 at one end and gradually gets thicker up to step 70. The constant-thickness section 68 also includes a textured surface segment 72 located at the opposite end of the flag 60 from thin section 74. It is worth noting that while the step 70 and textured surface 72 are shown on the outside (relative to the axis of rotation of actuator 54) of the curved surface of flag 60, these features may also be positioned on the inside surface of flag 60. The step 70 and textured surface 72 are described in more detail below.

Figure 13:
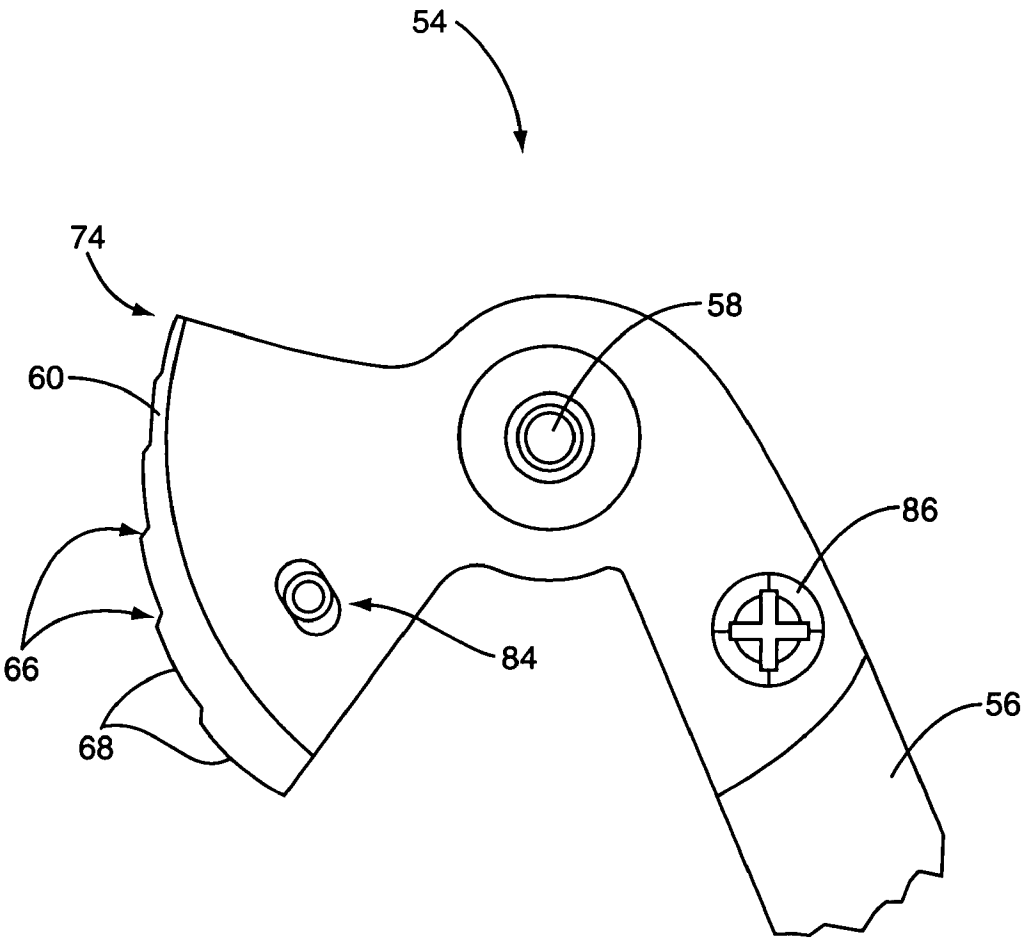
FIG. 13 is a side view of the stack height sensor flag according to one embodiment of the present invention.
Figure 14:
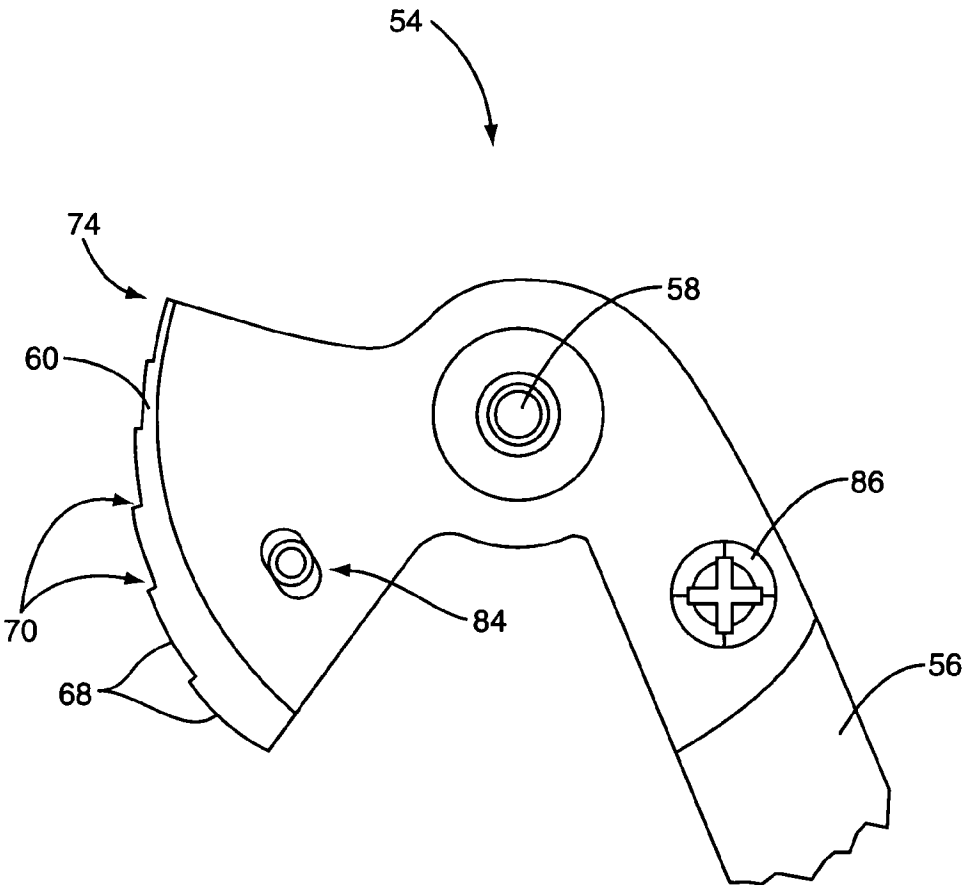
FIG. 14 is a side view of the stack height sensor flag according to one embodiment of the present invention.

Two more embodiments of the flag 60 are shown in FIGS. 13 and 14, respectively. In each embodiment, the flag 60 monotonically increases in thickness starting from a thin section 74. In the embodiment of FIG. 13, the flag 60 is characterized by a series of ramped sections 66 and constant-thickness sections 68. The thickness of flag 60 therefore increases in an intermittent fashion. In the embodiment of FIG. 14, the flag 60 is characterized by a stepwise increase in thickness. The flag in FIG. 14 has a series of steps 70 and constant-thickness sections 68. Other embodiments incorporating combinations of increasing or decreasing ramped sections 66, constant-thickness sections 68, and steps 70 are also possible as will be understood by those skilled in the art.

Figure 8:
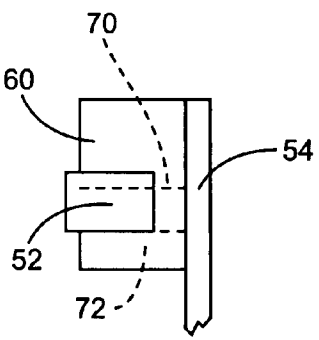
FIG. 8 is a partial front view of the stack height sensor showing the position of the flag relative to the sensor with a low media stack according to one embodiment of the present invention.
Figure 7:
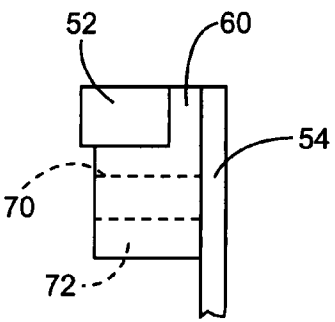
FIG. 7 is a partial front view of the stack height sensor showing the position of the flag relative to the sensor with a full media stack according to one embodiment of the present invention.
Figure 9:
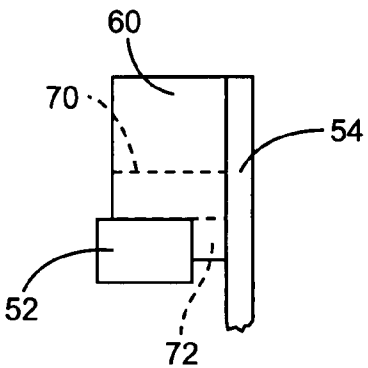
FIG. 9 is a partial front view of the stack height sensor showing the position of the flag relative to the sensor with an empty media stack according to one embodiment of the present invention.
Figure 6:
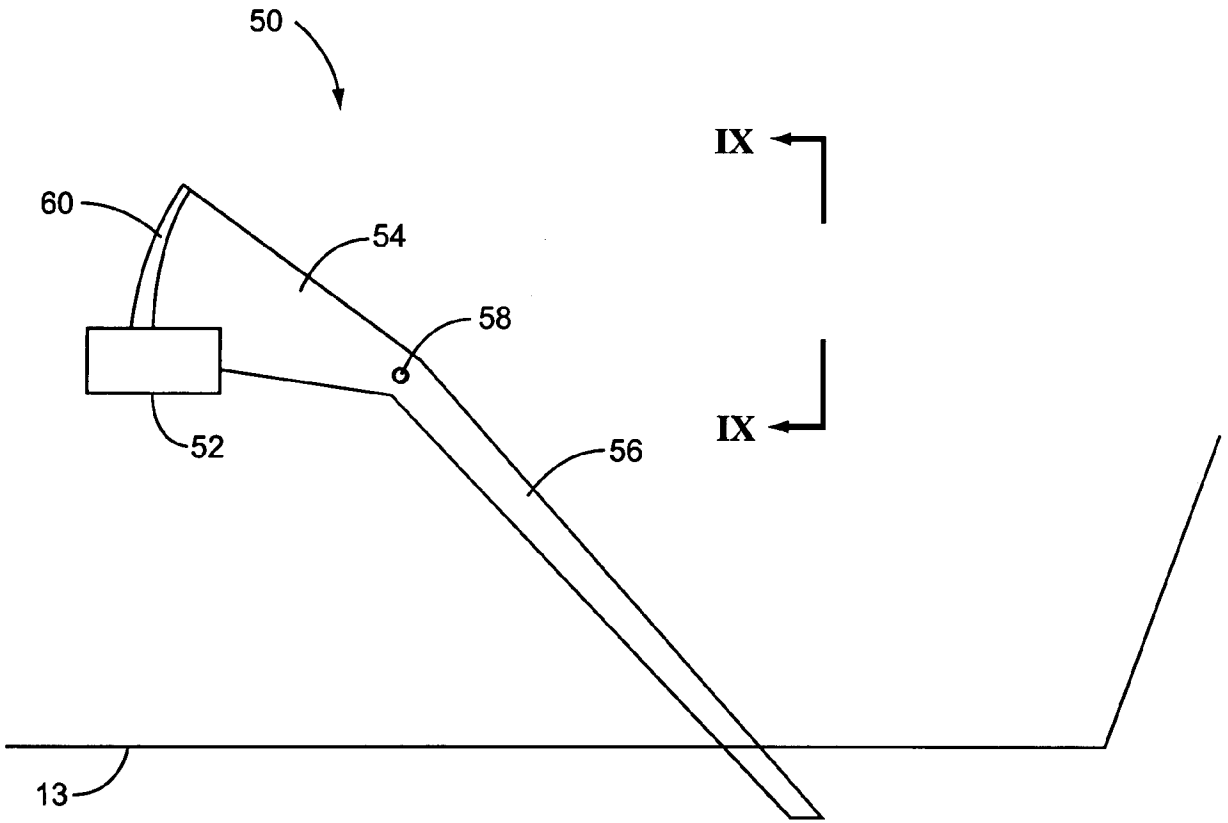
FIG. 6 is a side view of the stack height sensor with an empty media stack according to one embodiment of the present invention.

When the media stack 14*a* is full, as shown in FIG. 2, the thin section 74 of the flag is positioned within the sensor 52 transmission path. This position is also depicted in the partial front view shown in FIG. 7. In FIG. 7, the optional step feature 70 and textured surface feature 72 are hidden from view and represented by hidden lines. The same is true in FIGS. 8 and 9 discussed below. In this position, a relatively small fraction of incident energy is prevented from reaching the receiver 64. The energy may be blocked by some combination of scattering, diffusion, reflection, absorption, diffraction or other mechanisms as are known in the field of optics and electromagnetics. As the stack height lowers during normal use, for example as shown in FIG. 3, a thicker portion of the ramped section 66 is moved into the transmission path of sensor 52. The corresponding partial front view is shown in FIG. 8. In this lowered position, more energy is blocked by the flag 60 and hence, less is received by the receiver 64. As a further comparison, FIG. 6 shows the position of the actuator 54 when the media tray 13 becomes empty. The actuator arm 56 may travel beyond the bottom surface of the media tray 13 through an aperture that is not specifically shown. The aperture in the bottom of the media tray 13 allows the arm 56 and flag 60 to rotate through a relatively large displacement angle after the final sheet of media in the tray is removed. This relatively large displacement pulls the textured surface 72 of the flag 60 into the energy transmission path within sensor 52. This position is also illustrated in the partial front view shown in FIG. 9. In another embodiment, the actuator arm 56 contacts the bottom surface of the media tray 13 and stops rotation.

Figure 10:
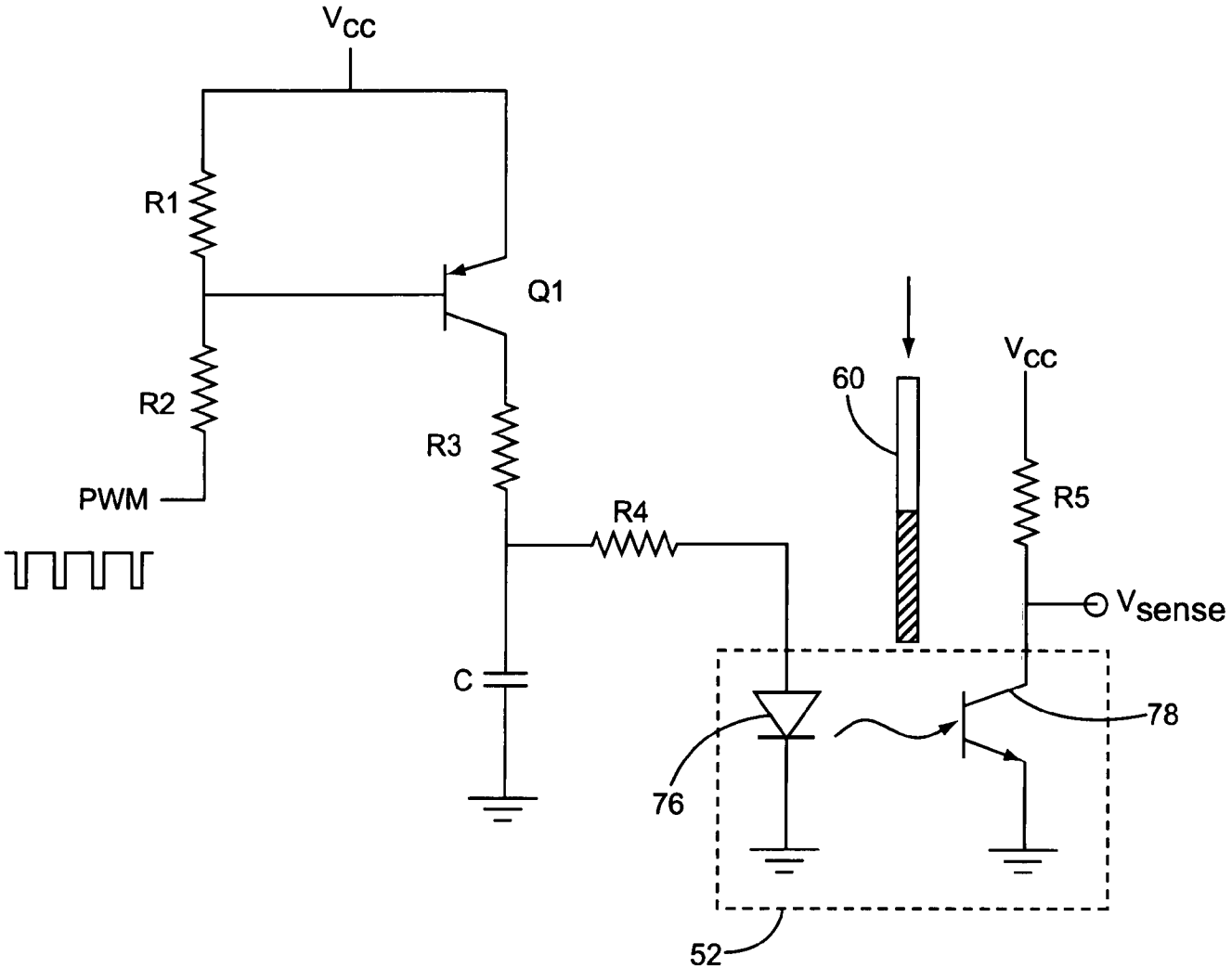
FIG. 10 is a schematic of an input and output circuit coupled to the stack height sensor according to one embodiment of the present invention.

As illustrated in FIG. 10, the sensor 52 may be coupled to an electronic circuit to generate a signal indicative of stack height. Particularly, the transmitter 62 is supplied with some driving power and the receiver 64 is coupled to a detection circuit to interpret the output from the sensor 52. One example of an input/output circuit is illustrated in FIG. 10. In the exemplary embodiment shown, the sensor 52 is comprised of an LED 76 and a photo-transistor 78. The sensor 52 may be selected to operate in the visible or infrared spectrums. In one embodiment, the sensor 52 is comprised of an LED 76 and photo-transistor 78 pair having matched spectral characteristics. The sensor 52 may be selected to operate in the infrared spectrum to decrease sensitivity to light sources that are external to the image forming apparatus 10. Similarly, the sensor 52 may be selected to operate in the visible spectrum to decrease sensitivity to thermal gradients within the image forming apparatus 10. In either case, the sensor 52 is advantageously selected to match the spectral transmission characteristics of the flag 60, which is moveable into the optical transmission path between the LED 76 and photo-transistor 78.

The output circuit depicted on the right side of FIG. 10 is a conventional common-emitter amplifier circuit, which generates an output that transitions from a high value to a low value as more optical energy is detected by the photo-transistor 78. The output is created by connecting a resistor R5 between the voltage supply ($V_{cc}$) and the collector of the photo-transistor 78. The output voltage $V_{sense}$ is read at the terminal of the collector and is inversely proportional to the amount of optical energy received by the photo-transistor 78. The photo-transistor may be operated in the active region where $V_{sense}$ is proportional to the amount of light received.

An alternative embodiment may incorporate a common-collector amplifier circuit, which generates an output that transitions from a low state to a high state as more optical energy is detected by the photo-transistor 78. While not specifically shown in FIG. 10, this type of output circuit is created by connecting a resistor between the emitter pin of the phototransistor and ground and reading $V_{sense}$ at the emitter terminal. Other filtering and amplification circuits may also be incorporated as needed.

The input circuit shown on the left side of FIG. 10 converts a pulse-width-modulated (PWM) input signal into an analog driving signal capable of generating optical energy from LED 76. The PWM input signal is input to a voltage divider comprised of resistors R1 and R2. The intermediate voltage between these resistors is used to drive a buffering transistor Q1. The resulting analog wave is filtered through a low-pass filter constructed from R4 and C. In one embodiment, the size of the filter components R4, C are selected to create a low pass cutoff below the fundamental frequency of the PWM circuit so as to allow only the direct current (DC) component of the input signal to pass and drive the LED 76. The resultant analog wave is an approximately constant DC voltage signal whose magnitude correspondingly varies with the duty cycle of the PWM signal.

The input circuit just described offers an advantage in that the power delivery to the LED 76 can be calibrated to compensate for design tolerances, sensitivity variations, and the like. The PWM input signal is delivered to the input circuit from a controlling processor and logic (not shown) that can be adapted to receive a feedback signal from the photo-transistor output ($V_{sense}$). The duty cycle of the PWM signal is adjustable based on the value of the feedback signal. It may be desirable to calibrate the sensor input signal at two different times. The first is when the flag 60 is present in the optical path between the LED 76 and photo-transistor 78. The second is when the flag 60 is absent from this same optical path.

Figure 11:
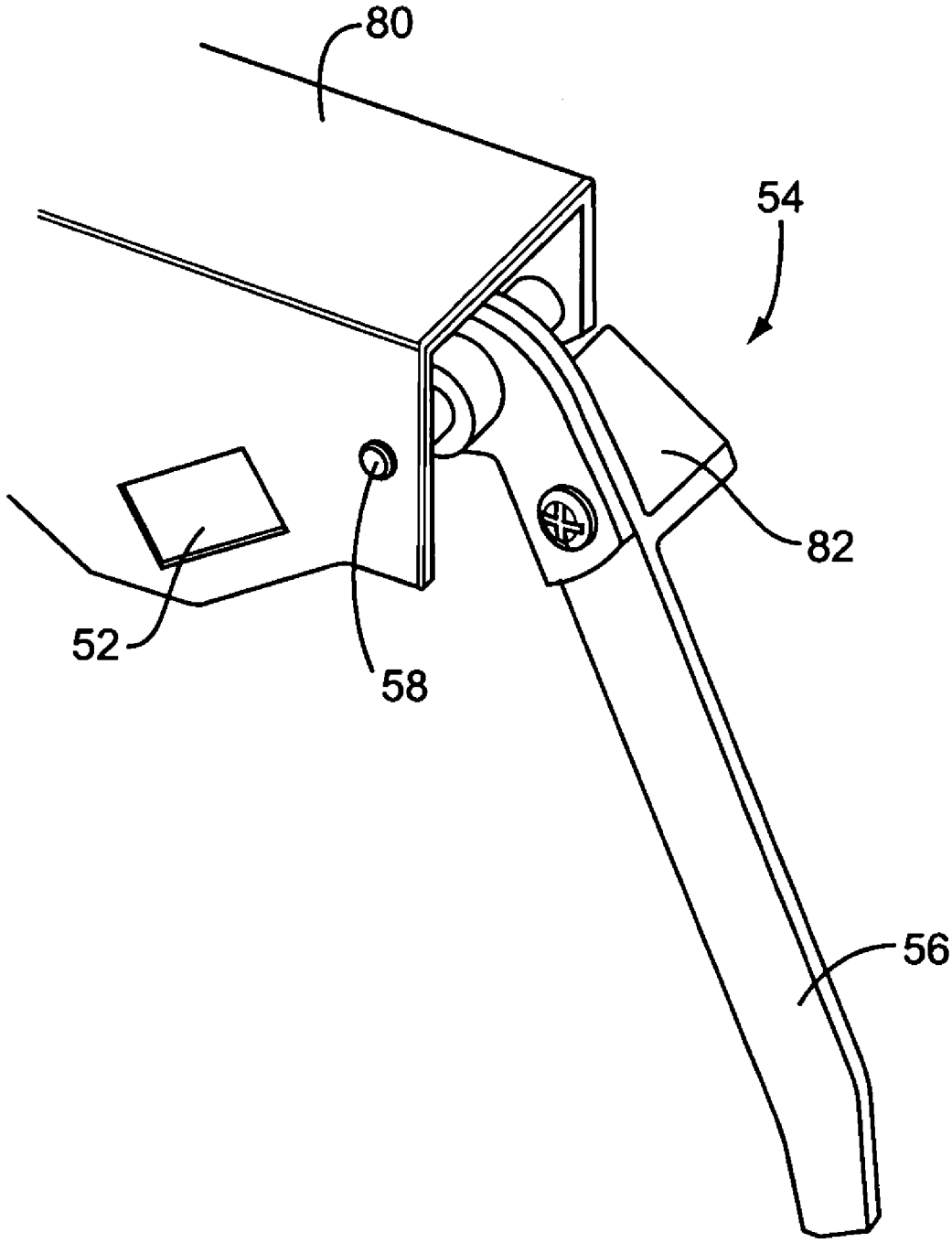
FIG. 11 is a partial perspective view of the flag arm according to one embodiment of the present invention.

In the latter case, some mechanism should be provided to remove the flag 60 from the sensor 52 for calibration. Referring now to FIG. 11, a perspective view of an actuator 54 in accordance with the present invention is shown assembled to a support structure 80 with the actuator moveable about pivot axis 58. Sensor 52 is also assembled to the support structure 80. The flag 60 is obscured from view in FIG. 11 because support structure 80 covers sensor 52 and flag 60 so as to prevent stray external light from affecting the operation of the stack height sensor 50. A lifting protrusion 82 extends laterally from the flag arm 56 and provides a surface by which the flag arm 56 can be lifted, thereby lowering the flag 60 out of the sensor 52 and away from the optical path between the transmitter 62 and 64.

In one embodiment, the lifting protrusion 82 can be lifted by the pick mechanism 16 shown in FIG. 1. Means for raising pick mechanisms 16 when the media tray 13 is removed from an image forming apparatus 10 are known in the art and will not be described further here. The flag arm 56 may be advantageously lifted upward by a pin, arm, or other protrusion (not shown) extending from the pick mechanism 16 that contacts the bottom surface of lifting protrusion 82. Thus, as the pick mechanism 16 is raised when the media tray 13 is removed, the flag arm 56 is also lifted and the flag 60 is removed from the sensor 52. It is during this time that the circuit shown in FIG. 10 may be calibrated. The light output from LED 76 is directed onto photo-transistor 78 without any interruption to produce the output voltage $V_{sense}$. The duty cycle of the PWM input signal may then be adjusted to appropriately raise or lower the output voltage $V_{sense}$ as desired. In one embodiment, $V_{cc}$ may be selected to be 3.3 volts and the PWM input signal is adjusted to yield a calibration value for $V_{sense}$ of approximately 0.8 to 1.0 volts. Thus, as the flag 60 is introduced into sensor 52, thereby allowing less light to reach photo-transistor 78, the output voltage $V_{sense}$ will increase and approach $V_{cc}$ as the flag 60 tends towards opaque. The sensor 52 also advantageously operates as a status indicator for media tray 13. If, following calibration, a value for $V_{sense}$ substantially equal to the calibration value is detected, it can be assumed that the flag 60 is removed from the optical path of the sensor 52. Thus, it may be inferred that the media tray 13 has been removed or is not properly seated.

Figure 12:
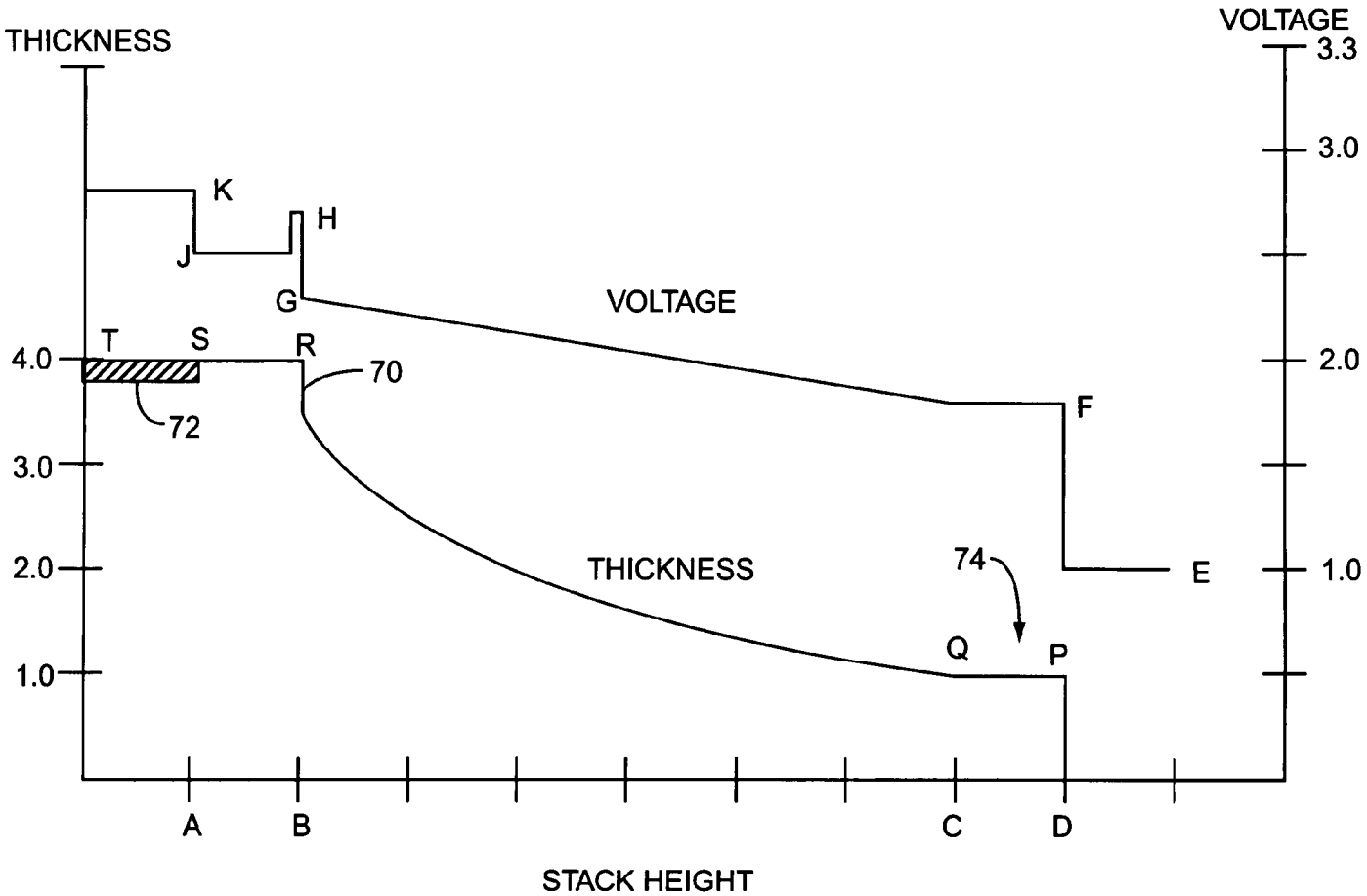
FIG. 12 is a composite graph showing the thickness profile of the flag and corresponding sensor output voltage according to one embodiment of the present invention.

Referring now to FIG. 12, two curves are provided. Letter designators are provided on both curves to refer to specific points and values on the curve. The lower curve shows the thickness profile for one embodiment of the flag 60. The vertical axis on the left side of the chart in FIG. 12 represents the thickness of the flag in mm. The upper curve represents the sensor output voltage, for example $V_{sense}$ as shown in FIG. 10. The vertical axis on the right side of the chart in FIG. 12 represents the sensor output in volts. The horizontal axis at the bottom of the chart in FIG. 12 represents the height of a media stack, such as media stack 14 in media tray 13 shown in FIG. 1. Point D represents a full media height, and point A represents an empty media tray. The area between points D and A represent declining amounts of media height, including points C and B. The area to the right of point D represents the condition where the media tray 13 is removed from the image forming apparatus 10 and the flag 60 is removed from the sensor 52. In this condition, the flag 60 may be represented as having zero thickness. Furthermore, in this condition, the stack height sensor 50 may be calibrated to yield a desirable starting output voltage as described above and as indicated by the level E in the upper curve of FIG. 12.

Starting at point P at the right side of the lower curve, the flag 60 has the thinnest cross section. This section corresponds to thin section 74 shown in FIG. 5. The flag 60 may immediately begin increasing in thickness from this thin section 74. Alternatively, as indicated by the line between points P and Q on the lower curve of FIG. 12, the thin section 74 may have a substantially constant thickness progressing to point Q. When this portion of the flag 60 is positioned within sensor 52 (i.e., when the media tray 13 is full or near full), the sensor output is at point F in the upper curve. It is worth noting that while the flag 60 is at its thinnest level, the flag 60 still interferes with optical energy traveling from the transmitter 62 to the receiver 64 and the output voltage is correspondingly higher than when the flag 60 is removed from the sensor 52. This higher voltage level is indicated by the increase from E to F in the upper curve.

Progressing now from point Q, the flag 60 increases in thickness up to a step at point R. This step corresponds to the step 70 shown in FIG. 5. The increase in thickness from point Q to the step at point R may be linear or curved as shown in FIG. 12. The choice of material for the flag 60 may yield a logarithmic relationship between thickness and light transmission. Therefore, a curved flag profile may advantageously yield a linear relationship between the output voltage and stack height. This linear relationship is represented by the straight line progression of output voltage from the full stack height C to the low stack height B at point G in the upper curve. In general, different flag thickness profiles may be incorporated to yield different voltage profiles. For example, it may be desirable to generate a large slope in the voltage profile for greater accuracy. Different flag thickness profiles incorporating some combination of features such as those shown in FIGS. 5, 13, and 14 may be used to achieve the desired results.

The step function increase in output voltage from point G to H occurs when the step 70 passes through the sensor 52. The step 70 in flag 60 is a discontinuity that redirects more energy than either surface immediately adjacent the step 70. This can be seen by the fact that point H in the upper curve of FIG. 12 is higher than points G and J. This voltage spike may advantageously provide an easily detectable indication of an intermediate or low condition for the media stack.

As additional media is consumed by the image forming apparatus 10, the position of the flag 60 within sensor 52 continues to change. However, with the embodiment shown in FIGS. 5 and 12, the thickness of the flag does not change from points R to S and therefore, the output voltage remains substantially constant at level J. However, when the media tray becomes empty, the flag arm 56 and flag 60 are rotated by a large amount as the flag arm 56 falls past the bottom of the media tray 13 as shown in FIG. 6. In the empty state, indicated by stack height A in FIG. 12, the textured region 72 (see FIG. 5 also) is brought into the sensor transmission path. The textured region 72 has a surface that is more rough or less smooth than the remainder of the constant-thickness section 68. This roughened surface may be generated by abrasives, knurling, rolling or other known manufacturing methods. The textured surface 72 causes increased scattering and reflection of the incident energy emitted by transmitter 62. Thus, less energy reaches the receiver 64 than in the remaining portion of the constant-thickness section 68. The output voltage correspondingly increases from level J to K. In another embodiment, the textured surface 72 may be a completely opaque section that blocks all energy transmission between the transmitter 62 and receiver 64. Further, while a constant-thickness section 68 is shown on the thick side of the step 70, another variable thickness section may be used instead. Also, the relative positions of the step 70 and textured surface 72 shown in the Figures are not intended to be limiting. The positions of these features, which are capable of generating discrete stack height information, may be adjusted according to the needs of a particular application.

The large displacement of the flag 60 as the media tray 13 becomes empty also avoids a narrow voltage spike that would otherwise occur when the transition to the textured surface 72 enters the sensor 52. It is also worth noting that voltage level K is higher than the voltage spike that occurs at point H when the step 70 enters the sensor 52. This output voltage distinction may advantageously provide a clear indication of the difference between the low and empty states. As such, the flag profile shown in FIGS. 5 and 12 is able to produce continuous stack height information in addition to discrete intermediate and limit levels.

The calibration of the sensor 52 was discussed generally above and the procedure for calibrating the stack height sensor 50 when the flag 60 is removed from the sensor 52 was specifically described. It may also be desirable to calibrate at an alternate or supplemental time when the flag 60 is inserted into the transmission path of sensor 52. This additional calibration may be used to compensate for variations in flag material, light transmission properties, and manufacturing or assembly tolerances. This calibration may be performed using the relatively flat or constant-transmissivity portion of the voltage curve located between the voltage spike at point H and the step at point J in FIG. 12. Alternatively, the calibration may be performed when the textured portion 72 is located in the sensor 52 transmission path. Note that the term constant-transmissivity does not strictly require a constant thickness, but simply a section that allows a relatively constant amount of optical energy to pass through to the receiver 64. One advantage to using either of these voltage levels is that they provide a clearly defined and locatable point in travel of the flag. These flat portions of the curve are identifiable by the steps at point H and K. Another advantage is that the output value $V_{sense}$ of sensor 52 may be determined while the flag 60 is in the sensor transmission path, thereby accounting for the physical and optical properties of the flag 60 and sensor 52. Thus, an appropriate threshold value for the sensor output signal $V_{sense}$ at the corresponding flag position may be established for each individual system.

It may also be desirable to provide some measure of fine adjustment to alter the position at which the step 70 enters the sensor. Referring again to FIG. 5, the flag 60 and flag arm 56 include an adjustment mechanism provided by the pin and slot configuration 84 and adjustment screw 86. Other adjustment means may be provided as will be understood by those skilled in the art. During product assembly or otherwise, the adjustment screw 86 can be loosened to allow relative movement between the flag 60 and the arm 56. The flag 60 may then be rotated about axis 58 as permitted by the pin and slot 84 so as to bring the step 70 into the sensor transmission path. This position can be detected by the resulting voltage spike seen in FIG. 12. Then the arm 56 can be positioned in the desired location. For example, the arm 56 may be positioned at a height reflecting 25 or 50 sheets remaining in the media tray 13. The adjustment screw 86 can then be tightened and the low media stack condition will be determinable during normal operation of the image forming apparatus 10. In an alternative embodiment, the position of sensor 52 may also be adjustable to adjust the activation point for the low media stack signal.

The present invention may be carried out in other specific ways than those herein set forth without departing from the scope and essential characteristics of the invention. For instance, the embodiments described have been depicted in use with a stack height sensor capable of producing discrete low and empty conditions. Other stack height sensors capable of producing discrete intermediate or full media stack states can also be employed. Furthermore, while the embodiments discussed have been described in the context of a pivoting stack height sensor 50, it may be desirable to implement a linearly actuated sensor. Similarly, it is also feasible to construct an alternative embodiment having a substantially fixed flag and a moving sensor that changes position relative to the flag as the stack height changes. The stack height sensor 50 may be incorporated in a variety of image forming apparatuses including, for example, printers, fax machines, copiers, and multi-functional machines including vertical and horizontal architectures as are known in the art of electrophotographic reproduction. The stack height sensor 50 may also be incorporated into non-image forming apparatuses including, for example, currency counters or dispensers and sheet processing machines. The present embodiments are, therefore, to be considered in all respects as illustrative and not restrictive, and all changes coming within the meaning and equivalency range of the appended claims are intended to be embraced therein.

What is claimed is:

1. An image forming apparatus comprising:

a body comprising a media tray into which a stack of media sheets are inserted;

a member moveably disposed in the body with a position of the member changing as the quantity of media sheets in the media stack changes;

an optical sensor comprising a transmitter that emits optical energy along an optical path and a receiver adapted to receive the optical energy; and a section of the member moving through the optical path, the section having a first region with a first thickness, a second region with a second thickness greater than the first, and having an increasing thickness therebetween with the movement of the section through the optical path causing a change in the amount of the optical energy received by the receiver;

the thicknesses of the section being defined between a first side that faces the transmitter and a second side that faces the receiver.

2. The image forming apparatus of claim 1 wherein the thickness of the section increases at a continuous rate from the first region to the second region.

3. The image forming apparatus of claim 1 wherein the thickness of the section increases in a stepwise manner from the first region to the second region.

4. The image forming apparatus of claim 1 wherein when the media tray is removed, the section moves out of the optical path so as not to change the amount of the optical energy received by the receiver.

5. The image forming apparatus of claim 1 wherein the section further comprises a textured surface moveable into the optical path when a limit of the quantity of media sheets in the media stack has been reached, the textured surface moving into the optical path causing a change in the optical energy received by the receiver.

6. The image forming apparatus of claim 5 wherein the textured surface is opaque.

7. The image forming apparatus of claim 5 wherein the limit corresponds to a full media tray.

8. The image forming apparatus of claim 5 wherein the limit corresponds to an empty media tray.

9. The image forming apparatus of claim 1 wherein the section further comprises a step moveable into the optical path when an intermediate quantity of media sheets in the media stack is reached.

10. A device to sense a quantity of media sheets in an image forming apparatus, the device comprising:

a member moveably disposed in the image forming apparatus with a position of the member changing as the quantity of media sheets in the image forming apparatus changes;

a sensor comprising a transmitter that emits electromagnetic energy along a transmission path and a receiver adapted to receive the electromagnetic energy from the transmission path; and a flag having a first section with a first transmissivity, a second section with a second transmissivity, and a transmissivity gradient therebetween, the flag positioned in the transmission path, the relative position between the flag and the sensor changeable by the member in response to the quantity of media sheets, the flag gradually varying the amount of electromagnetic energy transmitted by the transmitter that is received by the receiver in response to the position of the member.

11. The device of claim 10 wherein the electromagnetic energy is optical energy.

12. The device of claim 10 wherein the flag is operatively coupled to the member and moveably positioned relative to a substantially fixed sensor.

13. The device of claim 10 wherein the first section is positioned in the transmission path when the media stack is empty.

14. The device of claim 10 wherein the first section is positioned in the transmission path when the media stack is full.

15. The device of claim 10 wherein the second section is positioned in the transmission path when the media stack is full.

16. The device of claim 10 wherein the second section is positioned in the transmission path when the media stack is empty.

17. The device of claim 10 wherein the first section is thinner and has a larger transmissivity than the second section.

18. The device of claim 17 wherein the flag further comprises a step positioned in the transmission path when the media stack is at an intermediate height.

19. The device of claim 10 wherein the flag further comprises a textured portion positioned in the transmission path when the media stack is at a limit of the height of the stack of media sheets.

20. The device of claim 10 wherein the receiver is electrically coupled to an output circuit to generate a signal indicative of stack height.

21. A device to sense a height of a media stack in an image forming apparatus comprising:

a body comprising a media tray into which a stack of media sheets are inserted;

a flag arm moveably disposed in the body, a distal end of the flag arm biased into contact with a top surface the media stack, the position of the flag arm changing as the height of the media stack changes;

an optical sensor disposed in the body, the optical sensor comprising a transmitter that emits optical energy and a receiver that is adapted to receive the optical energy emitted by the transmitter; and a flag comprising:

a ramped section;

a constant thickness section;

a step between the ramped and constant thickness sections; and the flag being moveable by the flag arm so that as the position of the flag arm changes in relation to the stack height, a different portion of the flag is positioned between the transmitter and receiver to accordingly reduce the amount of optical energy received by the receiver with the ramped section causing a gradual reduction in the amount of optical energy.

22. The device of claim 21 wherein the receiver is electrically coupled to an output circuit to generate a sensed signal indicative of stack height.

23. The device of claim 22 wherein the sensed signal has a first calibration value when the media tray is not inserted into the body and a second stack height value when the media tray is inserted into the body.

24. The device of claim 21 further comprising a lifting mechanism to lift the flag arm when the tray is removed and thereby move the flag to a position other than between the transmitter and receiver.

25. The device of claim 21 wherein the ramped section has a thin section and a thicker section, and when the media tray is full, the thin section is positioned between the transmitter and the receiver.

26. The device of claim 21 wherein the ramped section has a thin section and a thicker section, and when the media tray is full, the thick section is positioned between the transmitter and the receiver.

27. The device of claim 21 wherein when the media tray is low, the step is positioned between the transmitter and the receiver.

28. The device of claim 21 wherein the flag further comprises a textured surface region disposed within the constant thickness section.

29. The device of claim 28 wherein when the media tray is empty, the textured section is positioned between the transmitter and the receiver.

30. The device of claim 29 wherein the media tray further comprises a hole through which the distal end of the flag arm falls when the media tray is empty.

31. A media sheet stack height sensor, comprising:

an optical transmitter;

an optical receiver operative to receive energy from the optical transmitter;

a member in contact with a moveable part of a media sheet stack;

a flag of varying optical transmissivity along a length thereof interposed in an optical path from the transmitter to the receiver, the flag coupled to the actuator so as to alter the position of the flag in the optical path in response to the height of the stack;

the media sheet stack height sensor operative to sense at least three heights of the media sheet stack by detecting a varying amount of the energy that passes through the flag.

32. The sensor of claim 31 wherein the actuator falls through a hole in a floor supporting the media sheet stack when the stack is empty.

33. The sensor of claim 31 wherein the flag is etched with a pattern of varying opacity.

34. The sensor of claim 31 wherein the flag is transmissive and has a ramped thickness.

35. The sensor of claim 31 wherein the flag further comprises a gradient of monotonically decreasing transmissivity along length thereof.

36. The sensor of claim 35 wherein the flag further comprises a step function decrease in transmissivity along a length thereof, the step function decrease indicating one of the three heights.

37. An image forming apparatus comprising:

a body into which a stack of media sheets are inserted;

a member moveably disposed in the body with a position of the member changing as the quantity of media sheets in the stack changes;

an optical sensor having a transmitter that emits optical energy along an optical path and a receiver adapted to receive the optical energy;

a section of the member moving through the optical path having a ramped thickness defined between a first side that faces towards the transmitter and a second side that faces towards the receiver, with the ramped thickness causing a change in the amount of the optical energy received by the receiver as the section moves through the optical path.

38. The image forming apparatus of claim 37 wherein the section of the member moving through the optical path ramps up.

39. The image forming apparatus of claim 37 wherein the section of the member moving through the optical path ramps down.

40. The image forming apparatus of claim 37 wherein the thickness of the section decreases at a continuous rate from a first region to a second region.

41. The image forming apparatus of claim 37 wherein the thickness of the section decreases in a stepwise manner from a first region to a second region.

42. A method of sensing a quantity of media in an image forming apparatus comprising:

tracking the quantity of media in the image forming apparatus with a member that changes position in response to the quantity of media;

moving a flag having a variable transmissivity in response to the position of the member;

directing light that is transmitted by a transmitter through some portion of the flag;

receiving some reduced amount of the light at a receiver after the light is directed through the flag; and determining the quantity of media based on the reduced amount of light received by the receiver.

43. The method of claim 42 further comprising directing light through a flag having a variable thickness.

44. The method of claim 43 further comprising directing light through a thin section to receive more light at the receiver.

45. The method of claim 44 further comprising indicating a full condition while directing light through the thin section.

46. The method of claim 43 further comprising directing light through a step change in thickness in the flag to receive less light than is received when light is directed through surfaces adjacent either side of the step.

47. The method of claim 46 further comprising indicating an intermediate condition when the step is sensed due to the lowered amount of received light.

48. The method of claim 46 further comprising indicating a low condition when the step is sensed due to the lowered amount of received light.

49. The method of claim 46 further comprising the steps of adjustably coupling the flag to the member and adjusting the position of the flag relative to the member while directing light through a step change in thickness in the flag.

50. The method of claim 43 further comprising directing light through a textured surface to receive less light than is received in an adjacent non-textured surface having a similar thickness.

51. The method of claim 50 further comprising indicating an empty condition when the textured surface is sensed due to the lowered amount of received light.

52. The method of claim 42 further comprising directing light through a thick section to receive less light at the receiver.

53. The method of claim 52 further comprising indicating an empty condition while directing light through the thick section.

54. The method of claim 42 further comprising the steps of directing light through an opaque area of the flag to receive no light and indicating that a limit of the quantity of media has been reached.

55. The method of claim 54 wherein the limit is an empty media stack.

56. The method of claim 42 further comprising calibrating the sensor after moving the flag to a position where the light received by the receiver is not directed through the flag.

57. The method of claim 56 wherein the step of moving the flag to a position where the light received by the receiver is not directed through the flag occurs while removing a removable media tray, into which the quantity of media is inserted, from the image forming apparatus.

58. The method of claim 42 further comprising generating a sensed output signal indicative of stack height, the sensed output signal being at least partly based on the amount of light received by the receiver.

59. The method of claim 58 further comprising directing light through a constant-transmissivity portion of the flag and establishing a threshold value for the sensed output signal corresponding to the flag position.

60. The method of claim 58 further comprising calibrating the sensed output signal to a calibration value after moving the flag to a position where the light received by the receiver is not directed through the flag.

61. The method of claim 60 wherein the step of moving the flag to a position where the light received by the receiver is not directed through the flag occurs while removing a removable media tray, into which the quantity of media is inserted, from the image forming apparatus.

62. The method of claim 61 further comprising determining that the removable media tray is removed from the image forming apparatus by detecting that the sensed output signal is substantially equal to the calibration value.

63. A method of sensing a quantity of sheets comprising:

transmitting light from a transmitter to a receiver along an optical path, the receiver operative to generate a signal proportional to a gradually changing intensity of the light received;

increasingly attenuating the light in response to the quantity of sheets; and determining at least three discrete quantities of sheets from the gradually changing intensity of the light received by the receiver;

wherein the step of variably attenuating the light comprises interposing a transmissive flag of varying thickness in the optical path.

64. The method of claim 63 wherein the step of variably attenuating the light further comprises moving the transmissive flag of varying thickness relative to a substantially fixed transmitter and receiver.

65. The method of claim 63 further comprising sensing an output signal from the receiver that varies at least partly in relation to the intensity of the light received by the receiver.

66. The method of claim 65 further comprising establishing a threshold value for the output signal while directing light through a constant-thickness portion of the flag.

67. The method of claim 63 further comprising determining one of the discrete quantities by applying a discontinuous increase in the attenuation of the intensity of the received light.

68. The method of claim 63 further comprising calibrating the transmitter and receiver while refraining from attenuating the light.

* * * * *